US006963073B2

(12) United States Patent
Martin et al.

(10) Patent No.: US 6,963,073 B2
(45) Date of Patent: Nov. 8, 2005

(54) RADIOPHARMACEUTICAL PIG OF TWO SECTIONS THAT ENABLES ONE SECTION TO TURN RELATIVE TO THE OTHER SECTION WITHOUT THE NEED TO MANUALLY GRASP THE OTHER SECTION

(75) Inventors: Matthew R. Martin, Remsenberg, NY (US); Kenneth Paladino, Mastic Beach, NY (US)

(73) Assignee: Biodex Medical Systems, Inc., Shirley, NY (US)

( * ) Notice: Subject to any disclaimer, the term of this patent is extended or adjusted under 35 U.S.C. 154(b) by 722 days.

(21) Appl. No.: 10/067,436

(22) Filed: Feb. 5, 2002

(65) Prior Publication Data

US 2003/0146399 A1 Aug. 7, 2003

(51) Int. Cl.[7] ..... G21F 1/00

(52) U.S. Cl. ..... 250/515.1; 250/505.1; 250/506.1; 250/507.1

(58) Field of Search ..... 250/515.1, 505.1, 250/506.1, 507.1

(56) References Cited

U.S. PATENT DOCUMENTS 5,672,883 A * 9/1997 Reich ..... 250/506.1
5,927,352 A * 7/1999 Wouters et al. ..... 141/330

* cited by examiner

*Primary Examiner*—John R. Lee
*Assistant Examiner*—James P. Hughes
(74) *Attorney, Agent, or Firm*—Gibbons, Del Deo, Dolan, Griffinger & Vecchione

(57) ABSTRACT

A radiopharmaceutical pig device that includes two pig sections and two complementary engaging elements that engage each other. One of the two complementary engaging elements in integral with one of the two pig sections. By holding the other of the two complementary engaging elements stationary while the two complementary engaging elements are engaged, the other section of the pig may be removed from the pig without having to grasp the sidewall of the one of the two pig sections. This other of the complementary engaging elements may be part of a pig retainer brace, a shipping container, and L-Block shield or a counter top.

13 Claims, 6 Drawing Sheets

RADIOPHARMACEUTICAL PIG OF TWO SECTIONS THAT ENABLES ONE SECTION TO TURN RELATIVE TO THE OTHER SECTION WITHOUT THE NEED TO MANUALLY GRASP THE OTHER SECTION

CROSS-REFERENCE TO RELATED PATENT APPLICATIONS

Patent application Ser. No. 09/878,502, entitled "Radiopharmaceutical Pig and Transportation Apparatus," filed Jun. 11, 2001.

BACKGROUND OF THE INVENTION

1. Field of the Invention

The present invention relates to a radiopharmaceutical pig that permits a technician to remove a radiopharmaceutical dose from the pig after removing one section of the pig from the other by rotating the one section relative to the other while not manually grasping the other section.

2. Incorporation by Reference

The disclosure of application Ser. No. 09/878,502, "Radiopharmaceutical Pig and Transportation Apparatus," filed Jun. 11, 2001, is incorporated herein by reference.

3. Discussion of the Related Art

Devices for transporting radiopharmaceutical doses are known. One such device is presently manufactured by Biodex Medical Systems, Inc. This device includes a lead radiopharmaceutical pig, a second lead shielding enclosure, and a polyethylene shipping container. A syringe containing a radiopharmaceutical substance is placed inside the pig. The pig is then placed in the lead enclosure that is within the shipping container. This arrangement satisfies federal requirements concerning maximum radioactivity level detectable at the outside of a container used to transport a radiopharmaceutical dose.

To gain access to the radiopharmaceutical dose, the pig must be removed from the second level shielding enclosure and then opened. Since the pig is formed of two sections that open by turning one with respect to the other, one is grasped and held stationary while the other is turned. Due to the weight of the pig, the section to be held stationary is placed on a surface and its side wall is grasped and held stationary during rotation of the other section. Since the lead shielding of the pig is thinner along its side wall close to where the two sections join than at its ends, a technician grasping the side wall may be exposed to radiation in excess of federal standards while opening the pig, unless the technician takes additional precautions to protect his/her hand from radiation exposure.

To further minimize exposure to radioactivity, it is desirable to remove the top of the pig and gain access to the syringe without grasping the pig in a manner that requires removal of the radiation lead shield. This is because grasping the pig with the hand increases hand exposure to radiation. Where the radiopharmaceutical in question is one used for Position Emission Tomography ("PET"), such as $F^{18}$-labeled fluorodeoxyglucose, the high initial dose required to be shipped in order to have a physiologically effective dose for treatment (480 mCi shipped to have a dose of 15 mCi available for administration to a patient ten hours later), increases the need to limit hand exposure to radiation.

Even in the case in which the entire pig is to be removed from the shipping container and placed behind radiation shielding on a counter top or other "hot" surface, the radiopharmaceutical-containing syringe will be accessed outside of the shipping container and radiation lead shielding. In this circumstance, it is similarly desirable to remove the top section of the pig and gain access to the syringe without grasping the sidewall of the pig at a location that was underneath where the radiation lead shielding was in the shipping container before removal of the pig, so as to minimize hand exposure to radiation.

Accordingly, there is a need for a radiopharmaceutical pig that permits the top section of the pig to be removed and the radiopharmaceutical dose contained therein to be accessed without having to grasp the sidewall of the bottom section of the pig, that is, that portion of the sidewall that is surrounded by the radiation lead shielding while in the shipping container.

BRIEF SUMMARY OF THE INVENTION

One aspect of the present invention concerns a radiopharmaceutical pig device that minimizes hand exposure to radiation while opening the pig device. The pig device includes two pig sections and two complementary engaging elements that engage each other. One of the two complementary engaging elements in integral with one of the two pig sections. By holding the other of the two complementary engaging elements stationary while the two complementary engaging elements are engaged, the other section of the pig may be removed from the pig without having to grasp the sidewall of one of the two pig sections. This other of the complementary engaging elements may be part of a pig retainer brace, a shipping container, an L-block radiation shield, a counter top, or any surface.

Thus, where the pig device is elongated with lead shielding that is thicker at both ends than along its sidewall, an additional, separate lead shield may remain in place about the sidewalls during opening of the pig device since there is no need to grasp the side wall underneath this additional, separate lead shield. Indeed, even where the pig has been removed from the separate lead shield, as may be the case when the pig device is removed from its shipping container and placed behind an L-block radiation shield, there is no need for a technician to grasp the sidewall at a location beneath where this additional, separate shield surrounded the sidewall since the pig may be opened by removing an upper one of two pig sections while holding the lower one of the two pig sections stationary via the complementary engaging elements.

DETAILED DESCRIPTION OF THE INVENTION

The invention provides a radiopharmaceutical pig configured to permit the top of the pig to be removed and the radiopharmaceutical dose contained within the pig to be accessed without having to grasp the portion of the sidewall of the pig that was underneath radiation lead shielding that is or was present while the pig was within a shipping container. Hand exposure to radiation is thereby minimized.

Figure 1:
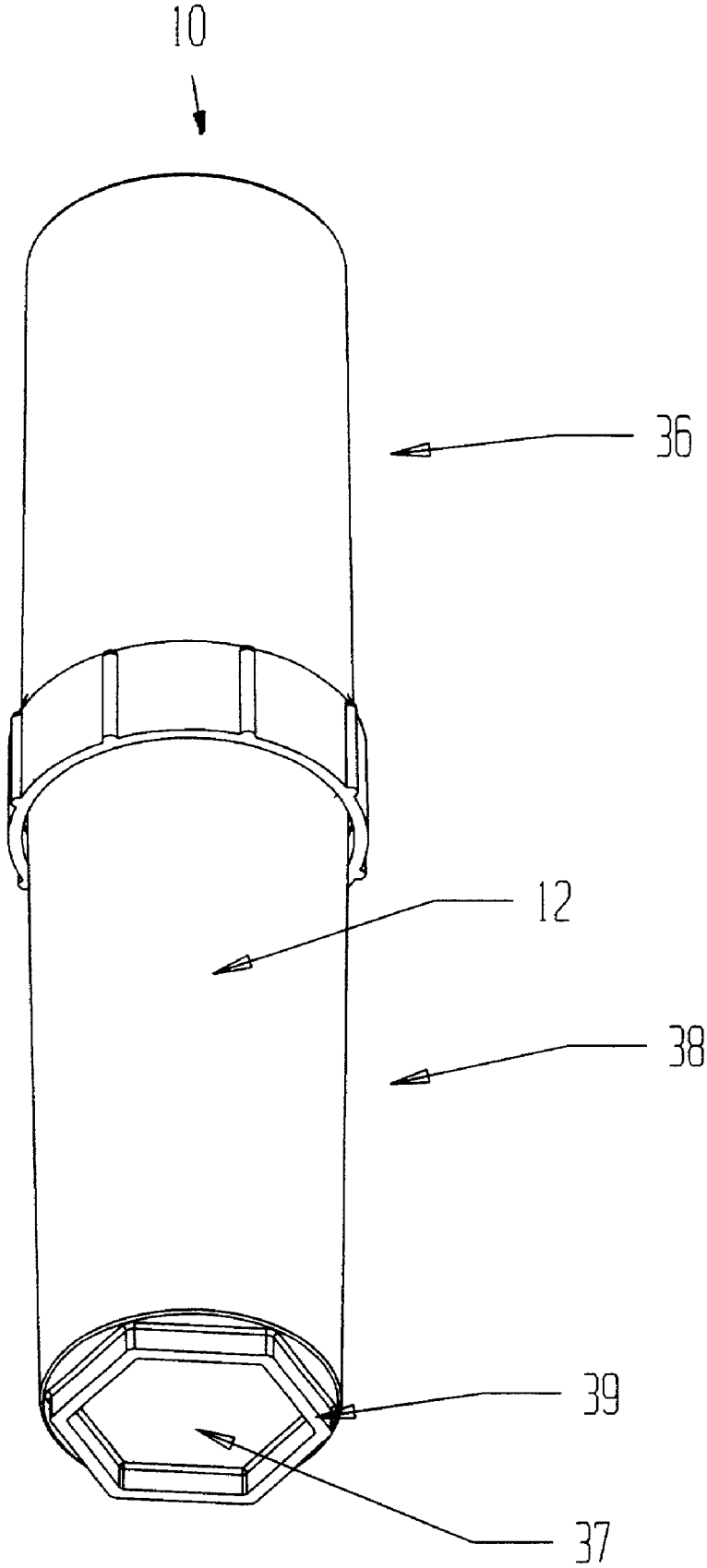
FIG. 1 shows a bottom perspective view of the pig of the present invention, showing a preferred embodiment of the attaching means of the pig.
Figure 4:
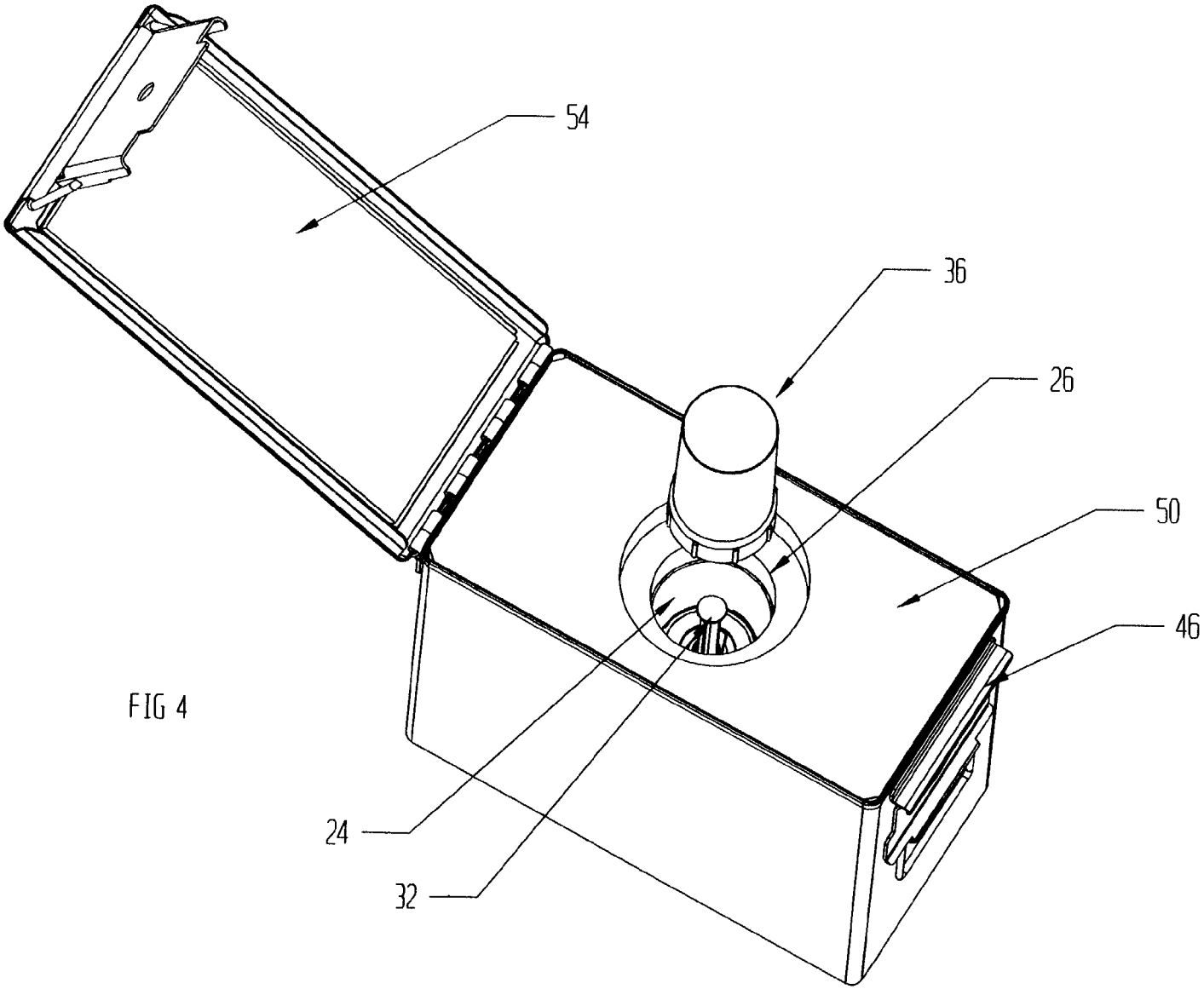
FIG. 4 shows a top, left, perspective view of the improved pig of the present invention, with the lid of the shipping container open and an upper section of the pig separated from the lower section of the pig, thereby providing access to contents of the pig.

Turning to FIG. 1, the radiopharmaceutical pig 10 of the present invention is elongated between opposite ends and is configured in two sections 36, 38 that engage each other to be rotatable with respect to each other between a fully engaged position and a fully separated condition. In the separated condition of FIG. 4, a syringe 32 containing a radiopharmaceutical dose is accessible. In the closed condition of FIG. 1, the syringe 32 of FIG. 4 is not accessible.

Figure 3:
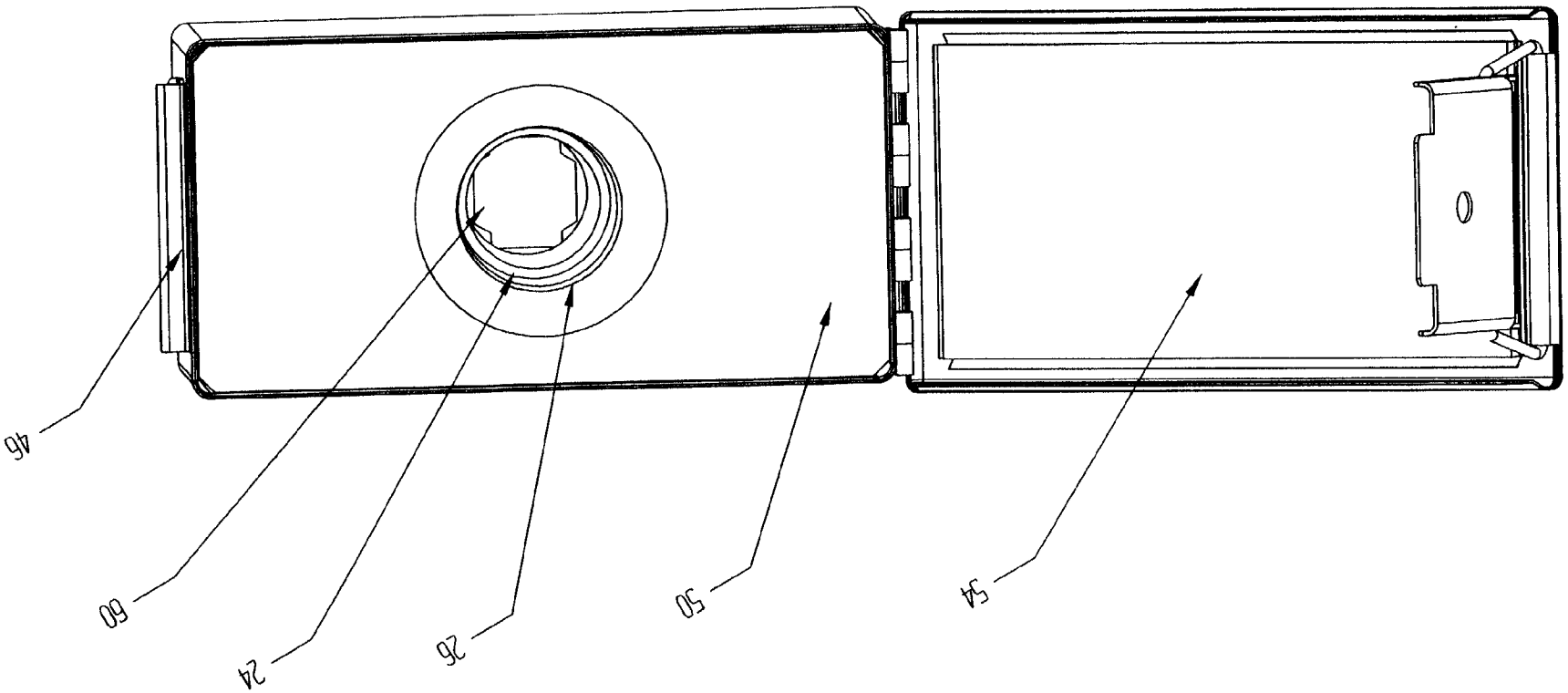
FIG. 3 shows a top view of the shipping container of FIG. 2, but without the pig.

As best seen in FIGS. 1 and 3, complementary configurations 39, 60 are provided for retaining one section 38 of the pig 10 in a manner that is fixed relative to the other section 36 so that this other section 36 may be rotated manually relative to the one section 38 without the need to manually grasp the one section 38 during the rotation. Eventually, this other section 36 separates from the one section 38 after completion of the relative rotation. That is, the sections 36, 38 may be rotatably engaged with each other by screw threads or the like.

The complementary configuration 39 may, but need not, comprise a multiple-sided ring extending from the bottom 37 of the one section 38 of the pig 10. As shown in FIG. 1, the ring comprising the complementary configuration 39 may be hexagonal. Alternatively, the ring may possess any plural number of sides greater than or equal to three.

Figure 2:
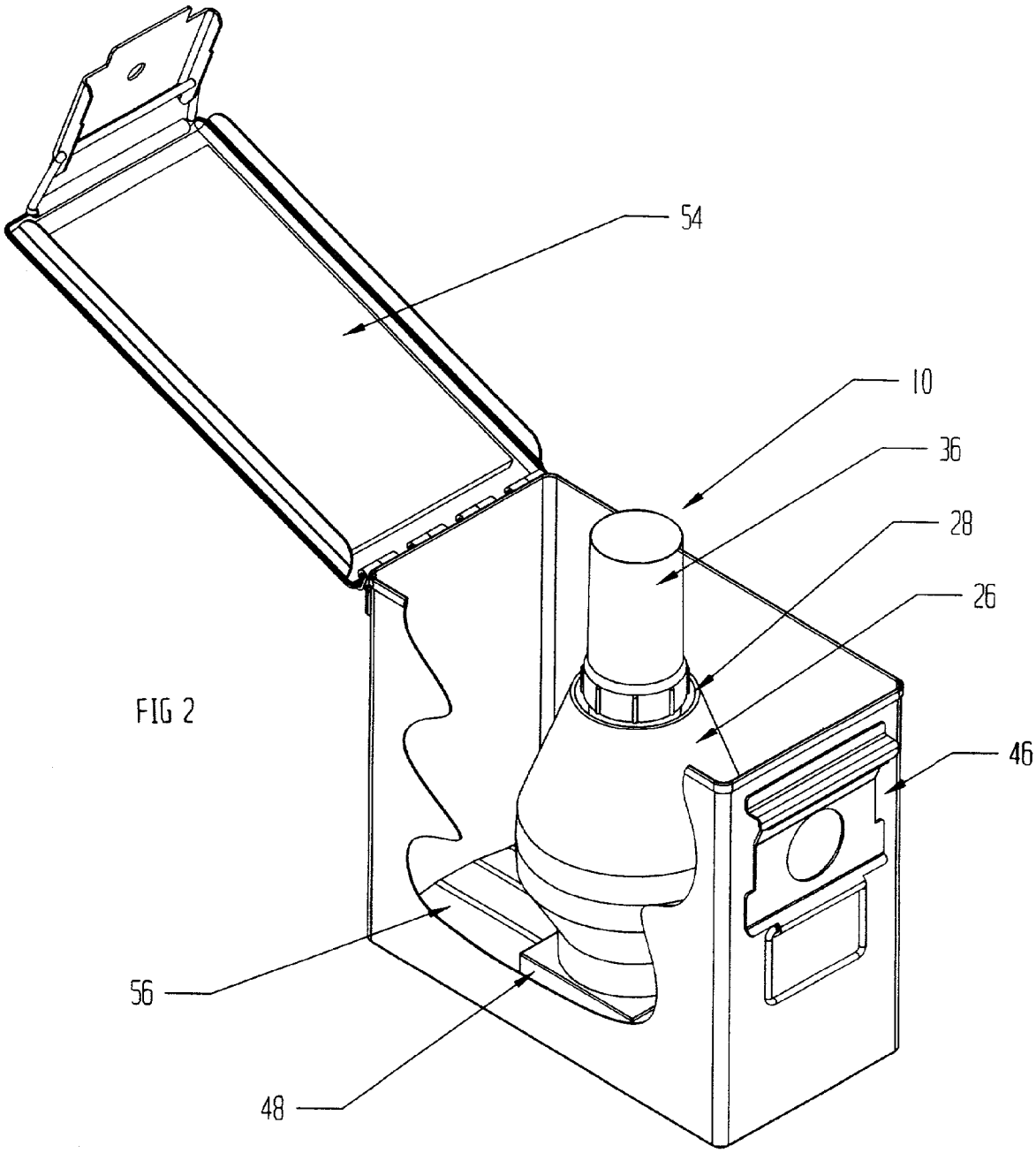
FIG. 2 shows a cutaway perspective view of a shipping container containing the pig of FIG. 1 within a lead radiation shield.

Each of the two ends of the pig 10 have a greater thickness of radiation lead shielding than the side wall 12. As best seen in FIG. 2, an additional radiation lead shield 26 is needed to surround the side wall to make up for this deficiency in the thickness of the lead shielding in the side wall as compared to that within the top and bottom ends so as to resist penetration of radiation outwardly to acceptable radiation limits. As a result, the radiation penetration resistance through the lead radiation shielding in the side wall and through the radiation lead shield 26 may be the same as through the lead shielding of the top end of the pig 10.

The complementary configuration 60 of FIG. 3 may be, but need not be, configured as a multiple-sided indentation and configured to fit the complementary configuration 39. The complementary configuration 39 may be, but need not be, shaped as a multiple-sided ring that extends from the bottom 37 of the one section 38 of the pig 10.

Alternatively, the complementary configuration 39 instead may be formed as a hexagonal indentation, while the complementary configuration 60 instead may be formed as a hexagonal ring. That is, it makes no difference whether the complementary configuration 39 is the male connector and the complementary configuration 60 is the female connector or vice versa.

FIG. 2 shows the pig 10 used in combination with a shipping container 46 for shipping radiopharmaceuticals. As shown, a lid 54 is open, after having been released from its fastened condition in a conventional manner. The entire pig 10 is inserted within the radiation lead shield 26 by being lowered through the open end 28 of the radiation lead shield 26. The radiation shield 26 rests on a bracket 48 securably attached to the inner surface of the base 56 of the container 46.

FIG. 3 shows that the complementary configuration 60 is accessible beyond the bottom of the cavity 24 of the radiation lead shield 26. The complementary configuration 39 (shown in FIG. 1 but not shown in FIG. 3) on the one section 38 (shown in FIG. 1 but not shown in FIG. 3) of the pig 10 engage the complementary configuration 60 (shown in FIG. 3), thereby securing the one section 38 of the pig 10. With the pig 10 so secured, the other section 36 of the pig may be removed, such by twisting or rotating this other section 36, while the one section 38, with the radiopharmaceutical-containing syringe inside, remains fully shielded about its sidewall by the radiation lead shield 26.

FIG. 4 shows the other section 36 of the pig 10 in the separated condition so that access is provided to the radiopharmaceutical-containing syringe 32 while the syringe 32 remains within the one section 38 of the pig 10. The pig 10 itself is within the cavity 24 of the radiation shield 26, all within the shipping container 46. The syringe 32 containing the radiopharmaceutical dose is thus able to be accessed without having to grasp the portion of the sidewall 12 of the pig 10 that is beneath the radiation shield 26. Hand exposure to radiation accordingly is minimized.

Figure 5:
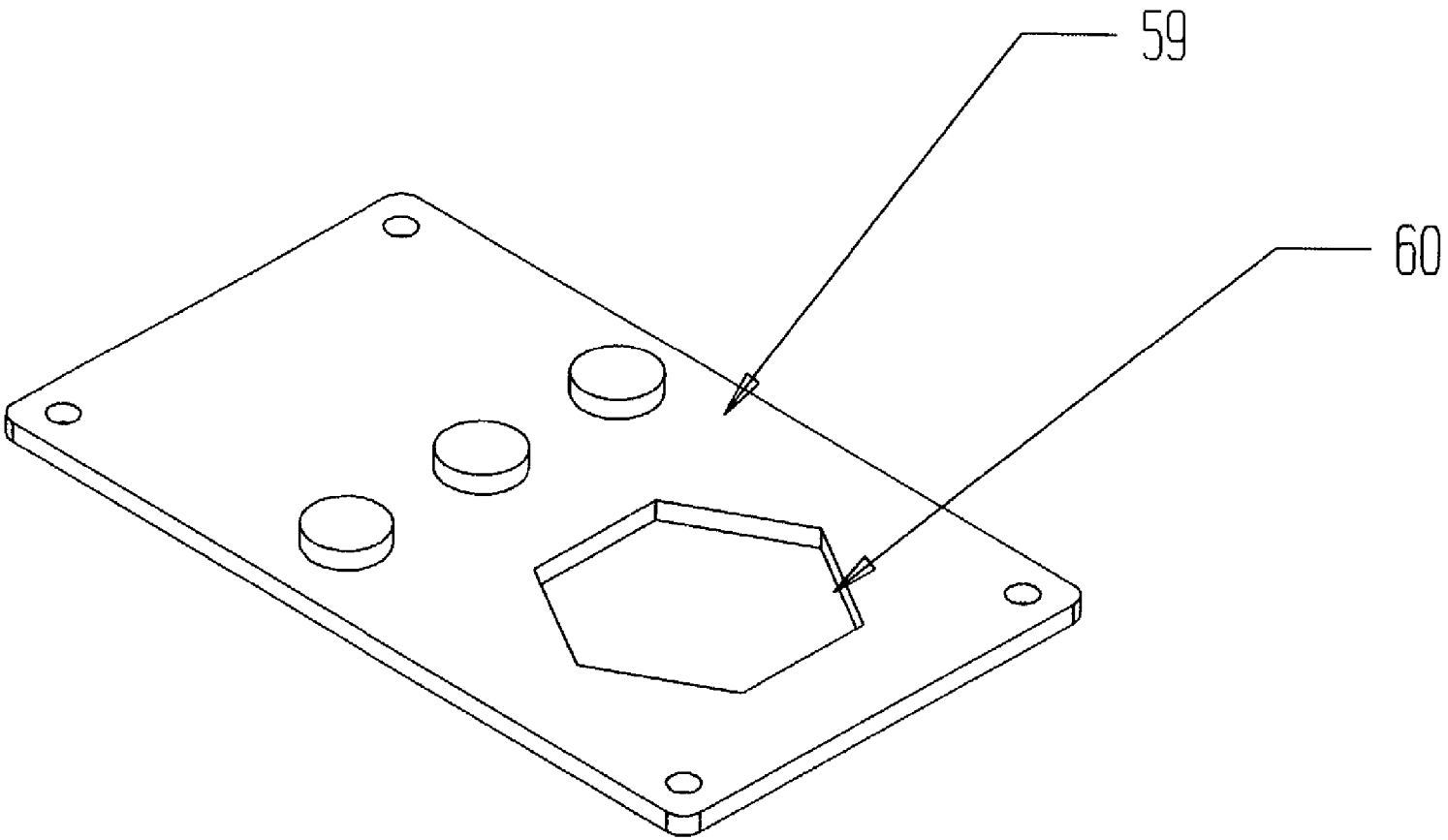
FIG. 5 shows a top perspective view of a pig retention brace of the present invention.

FIG. 5 shows an embodiment of a pig retention brace 59 that includes the complementary configuration 60 arranged to engage the complementary configuration 39 of the one portion 38 of the pig 10. The complementary configuration 60 of a pig retention brace 59 is configured to engage the complementary configuration 39 on the one section 38 of the pig 10, thereby permitting the other section 36 thereof to be removed without having to grasp a portion of the sidewall 12 of the pig 10, i.e., the portion being at a location underneath where the radiation lead shield 26 surrounded the sidewall during shipment.

Figure 6:
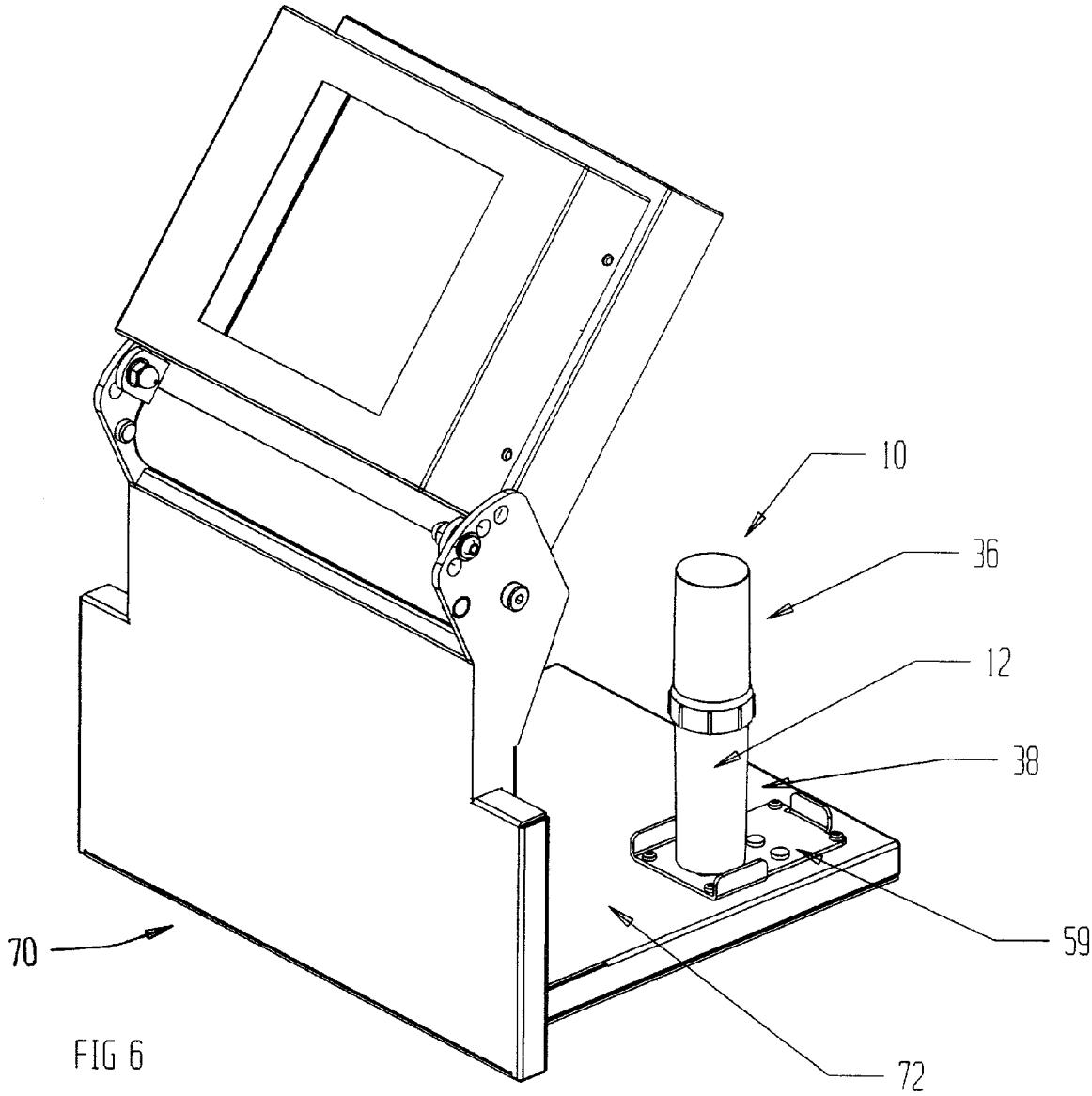
FIG. 6 shows a schematic representation of the pig of FIG. 1, the pig retention brace of FIG. 5, and an L-block radiation shield.

FIG. 6 shows the pig 10 used in combination with an L-block radiation shield 70 or a "hot" laboratory counter top. In this embodiment, the retention brace 59 is securably attached to an upper surface of the base 72 of the L-Block shield 70. The complementary configuration 38 of the pig 10 engages the complementary configuration 60 of the retention brace 59, thus permitting the other section 36 of the pig to be removed by relative rotation or turning—and the radiopharmaceutical dose to be accessed—again without having to grasp the portion of the sidewall 12 of the pig 10 that was beneath the radiation lead shield 26 within the container 46. When the pig 10 and retention brace 59 are used in combination with a "hot" laboratory counter top, the retention brace 59 is securably attached to the upper surface of the counter top. Subsequently, the complementary configuration 38 of the pig 10 and the complementary configuration 60 of the retention brace 59 may be engaged together as above, permitting removal of the other section 36 of the pig 10 without having to grasp the sidewall 12.

The complementary configuration 39 may be used in combination with a single-dose pig 10, as well as with a multiple dose pig 10, which is disclosed in application Ser. No. 09/878,502, "Radiopharmaceutical Pig and Transportation Apparatus," filed Jun. 11, 2001, whose contents are incorporated herein by reference. Instead of a single syringe within the confines of the pig 10, there are multiple syringes each within its own respective chamber. Furthermore, multiple pigs each with a complementary configuration 39 may be stored together within a common shipment container, which is not shown but is the same in configuration as the shipment container 46 except longer with multiple complementary configurations 60 arranged to align with respective ones of the complementary configurations 39 of the pigs when secured in position.

The complementary configuration 39 may be made out of the same material as the pig 10, and may be formed by conventional means, such as molding. The retention brace 59 may be made out of any rigid, durable material, such as metal. The complementary configuration 60 may be formed as part of the retention brace 59 by any conventional means, such as metal punching.

While the invention has been described with respect to certain specific embodiments, it will be appreciated that many modifications and changes may be made by those skilled in the art without departing from the invention. It is intended, therefore, by the appended claims to cover all such modifications and changes as may fall within the true spirit and scope of the invention.

What is claimed is:

1. A radiopharmaceutical pig device that enables separation of two pig sections from each other without any need to manually grasp a rotationally stationary one of the two pig sections while moving a movable one of the pig sections to effect the separation, comprising:

two pig sections configured to accommodate and enclose radiopharmaceutical contents while the two pig sections are in an engaged condition, the two pig sections including a rotationally stationary one and a movable one; and two complementary engaging elements that engage each other, the two complementary engaging elements including an integral one and a separate one, the integral one being integrally formed with the rotationally stationary one of the two pig sections, the separate one being configured to hold rotationally stationary the integral one while being held rotationally stationary and while the two complementary engaging elements are engaged with each other, the two pig elements being arranged to permit separation from each other in response to disengaging the two complementary engaging elements from each other and thereafter moving the movable one of the two pig sections away from the rotationally stationary one of the two pig sections, but without any need to manually grasp the rotationally stationary one of the two pig sections to effect the separation.

2. The radiopharmaceutical pig device of claim 1, wherein the complementary engaging elements comprise a multiple-sided ring and a multiple-sided recess or indentation.

3. The radiopharmaceutical pig device of claim 2, in combination with a separate element, wherein the separate one of the two complementary elements being integral with the separate element, the separate element being selected from a group consisting of a shipping container that is sized to accommodate insertion of the two pig sections, a retention brace, an L-block radiation shield and a counter top.

4. The radiopharmaceutical pig device of claim 1 in combination with a pig retention brace and an L-block radiation shield, the pig retention brace having the separate one of the complementary engaging elements and being secured to the L-block radiation shield.

5. The radiopharmaceutical pig device of claim 1, wherein each of the two pig sections have a respective end portion having a thickness and a sidewall portion adjacent to the end portion, the thickness of each of the end portions being thicker than that of each of the sidewall portions.

6. A method of separating two pig sections of a radiopharmaceutical pig device from each other without any need to manually grasp a rotationally stationary one while moving a movable one to effect the separation, comprising:

engaging two pig sections with each other in an engaged condition, the two pig sections including the rotationally stationary one and the movable one;

accommodating and enclosing radiopharmaceutical contents between the two pig sections while the two pig sections are in the engaged condition;

engaging two complementary engaging elements with each other, the two complementary engaging elements including an integral one and a separate one the integral one being integrally formed with one of the two pig sections; and holding rotationally stationary the integral one with the separate one while holding rotationally stationary the separate one and while the two complementary engaging elements are engaged with each other; and separating the two pig sections from each other in response to disengaging the two complementary engaging elements from each other and thereafter moving the movable one of the two pig sections away from the rotationally stationary one of the two pig sections, but without any need to manually grasp the rotationally stationary one of the two pig sections to effect the separating.

7. A method of claim 6, wherein the holding stationary includes fixing a separate element against movement, the separate element having the separate one of the complementary engaging elements, the separate element being selected from a group consisting of a shipping container that is sized to accommodate insertion of the two pig sections, a retention brace, an L-block radiation shield and a counter top.

8. A method of claim 6, wherein the holding stationary includes securing a pig retention brace to an L-block radiation shield, the pig retention brace having the separate one of the complementary engaging elements.

9. A method of claim 6, further comprising providing each of the two pig sections with end portions whose thickness is greater than that of portions of sidewalls adjacent to the end portions.

10. The radiopharmaceutical pig device of claim 1, wherein the two pig sections when engaged with each other have opposite ends, the rotationally stationary one of the pig sections having one of the opposite ends and the movable one of the pig sections having the other of the opposite ends, the one of the opposite ends that belongs to the rotationally stationary one of the pigs having the integral one of the complementary engaging elements.

11. The radiopharmaceutical pig device of claim 10, wherein the integral one of the complementary engaging elements has a configuration that is selected from a group consisting of a multiple-sided ring and a multiple-sided indentation.

12. A method of claim 6, wherein the two pig sections when engaged with each other have opposite ends, the rotationally stationary one of the pig sections having one of the opposite ends and the movable one of the pig sections having the other of the opposite ends, the one of the opposite ends that belongs to the rotationally stationary one of the pigs having the integral one of the complementary engaging elements.

13. A method of claim 12, wherein the integral one of the complementary engaging elements has a configuration that is selected from a group consisting of a multiple-sided ring and a multiple-sided indentation.

* * * * *